US005275345A

United States Patent [19]

Stahl et al.

[11] Patent Number: 5,275,345

[45] Date of Patent: Jan. 4, 1994

[54] STRIP COILER

[76] Inventors: Werner Stahl, Zum Hohlen Stein 20, D-57223 Keuztal; Josef Tröster, Kurfürst-Heinrich-Strasse 27, D-57462 Olpe; Axel Barten, Im Gensterfeld 20, D-5900 Siegen-Sohlbach, all of Fed. Rep. of Germany

[21] Appl. No.: 896,926

[22] Filed: Jun. 11, 1992

Related U.S. Application Data

[63] Continuation of Ser. No. 620,105, Nov. 30, 1990, abandoned.

[30] Foreign Application Priority Data

Nov. 30, 1989 [DE] Fed. Rep. of Germany ..... 3939561

[51] Int. Cl.[5] ..... B65H 18/26; B65H 23/00

[52] U.S. Cl. ..... 242/67.1 R; 242/78.1

[58] Field of Search ..... 242/67.1R, 65, 66, 75.1, 75.2, 78.1

[56] References Cited

U.S. PATENT DOCUMENTS

| | | | |
|---|---|---|---|
| 2,743,879 | 5/1956 | Saco et al. | 242/66 |
| 3,602,448 | 8/1971 | Muensterer | 242/67.1 R |
| 3,834,642 | 9/1974 | Kampf | 242/67.1 R |
| 4,095,755 | 6/1978 | Snygg et al. | 242/66 |
| 4,143,828 | 3/1979 | Braun et al. | 242/67.1 R |
| 4,343,440 | 8/1982 | Engl | 242/67.1 R |
| 4,365,767 | 12/1982 | Benthimere | 242/67.1 R |
| 4,469,286 | 9/1984 | Greding | 242/67.1 R |
| 4,491,283 | 1/1985 | Pav et al. | 242/67.1 R |
| 4,830,303 | 5/1989 | Hagens et al. | 242/67.1 R |
| 4,883,233 | 11/1989 | Saukkonen et al. | 242/66 |
| 5,054,707 | 10/1991 | Olson | 242/67.1 R |

FOREIGN PATENT DOCUMENTS

| | | | |
|---|---|---|---|
| 7609748 | 9/1978 | Fed. Rep. of Germany . | |
| 3710412 | 10/1988 | Fed. Rep. of Germany | 242/67.1 R |

*Primary Examiner*—Daniel P. Stodola
*Assistant Examiner*—John Q. Nguyen
*Attorney, Agent, or Firm*—Young & Thompson

[57] ABSTRACT

The strip coiler (1) for winding up and unwinding thin-gage and foil strip material of metal comprises a horizontal, motor-driven coiler mandrel (3) rotatably supported in a machine stand, for receiving the coiler reel (4) of a coil (5), and at least one smoothing roll (6) movable toward and away from the coiler mandrel (3) for pressing the strip (2) against the coil (5). The strip coiler (1) is equipped with control capability for the horizontal desired position of the smoothing roll (6), oriented in parallel to the coiler mandrel (3), this control being performed by an adjustment of the controlling forces of the operating cylinders for pressing the smoothing roll (6) against the coil (5) in dependence on the inclined positioning of the smoothing roll (6) caused by defects in the strip (2) or by unavoidable out-of-roundness of the surface of the wound-up strip (2). The strip coiler (1) is furthermore provided with regulating means for setting the distance (a) between the point of first contact (12) of the strip (2) with the coil (5) and the contact point (13) of smoothing roll (6) and coil (5) in dependence on the coil diameter (14).

1 Claim, 3 Drawing Sheets

STRIP COILER

This application is a continuation of application Ser. No. 07/620,105, filed Nov. 30, 1990, now abandoned.

The invention relates to a strip coiler for winding up and unwinding thin-gage and foil strip material of metal, with a horizontal coiler mandrel rotatably supported in a machine stand with a motor drive mechanism for receiving the coiler reel of a coil, and at least one smoothing roll adjustable by motor with respect to the coiler mandrel for pressing the strip against the coiler mandrel and, respectively, the coil, and with a control of the horizontal desired position of the smoothing roll, oriented in parallel to the coiler mandrel, by adjustment of the control forces of the operating cylinders for pressing the smoothing roll against the coil in dependence on the out-of-roundness of the coil caused by the winding process (DE 76 09 748 U1).

Considerable amounts of air are incorporated during winding into the coil when coiling thin-gage and foil strip after rolling on a strip coiler of the type discussed above. A conventional smoothing roll can abolish this problem only inadequately. The residual air incorporated into the coil causes defects on the coil during the winding step, such as cracks, twists, and transverse undulations which can lead to the complete uselessness of the coil.

The smoothing roll utilized together with the strip coiler fulfills two functions. On the one hand, the smoothing roller presses the entering thin-gage or foil strip against the coil, with the result that a portion of the air adhering to the entering thin-gage or foil strip is squeezed out, and a portion of the air wound into the coil is forced out of the coil. On the other hand, the smoothing roll takes care of a smooth, straight-edged winding up of the strip onto the coiler reel.

The problem arising in case of a strip coiler with smoothing roll is that the windings run obliquely onto the coil upon the occurrence of flaws in the strip entering the coil, such as flatness defects due to long or short strip edges, and edge roughnesses. As a result, the smoothing roll, urged against the coil by means of pressure cylinders, will likewise assume an inclined orientation and will jam in the pivot levers carrying this roll so that perfect windup of the strip onto the coil is no longer ensured due to the permanently inclined positioning of the smoothing roll.

Strip windings entering the coil with oblique orientation and unavoidable out-of-roundnesses on the surface of the thin-gage and foil strip wound onto the coiler reel lead to vibration movements of the smoothing roll whereby dynamic forces of inertia occur which are superimposed on the static contact force of the smoothing roll. The dynamic inertial forces lead, particularly in case of critical vibration ranges, to an impact stress on the coil by the smoothing roll and to damage to the thin-gage or foil strip, as well as the smoothing roll.

It is an object of the invention to develop a control for adjusting the smoothing roll of the strip coiler of the type discussed herein, permitting a smooth, straight-edged windup of the strip onto the coiler reel, and reduction of the quantity of air incorporated by winding to a minimum.

In order to obtain this object, the strip coiler of the type discussed herein is equipped with a control for setting the desired position of the smoothing roll, oriented in parallel to the coiler mandrel, and with a control for setting the distance between the entrance point of the strip on the coil and the contact point of smoothing roller and coil.

The regulation by way of the operating cylinders of the smoothing roll brings about the horizontal desired position of the smoothing roll so that an oblique running up of the thin-gage or foil strip onto the coil on account of strip defects or unavoidable out-of-roundness of the surface of the strip wound onto the coiler reel is eliminated in a minimum period of time. The spacing regulation between the smoothing roll and the point of first contact of the strip with the coil makes it possible to optimally position the smoothing roll with respect to the strip entrance point for varying coil diameters, with a view toward a minimum incorporation of air into the coil.

The invention will be described below with reference to schematic drawings of a strip coiler. In the drawings.

Figure 1:
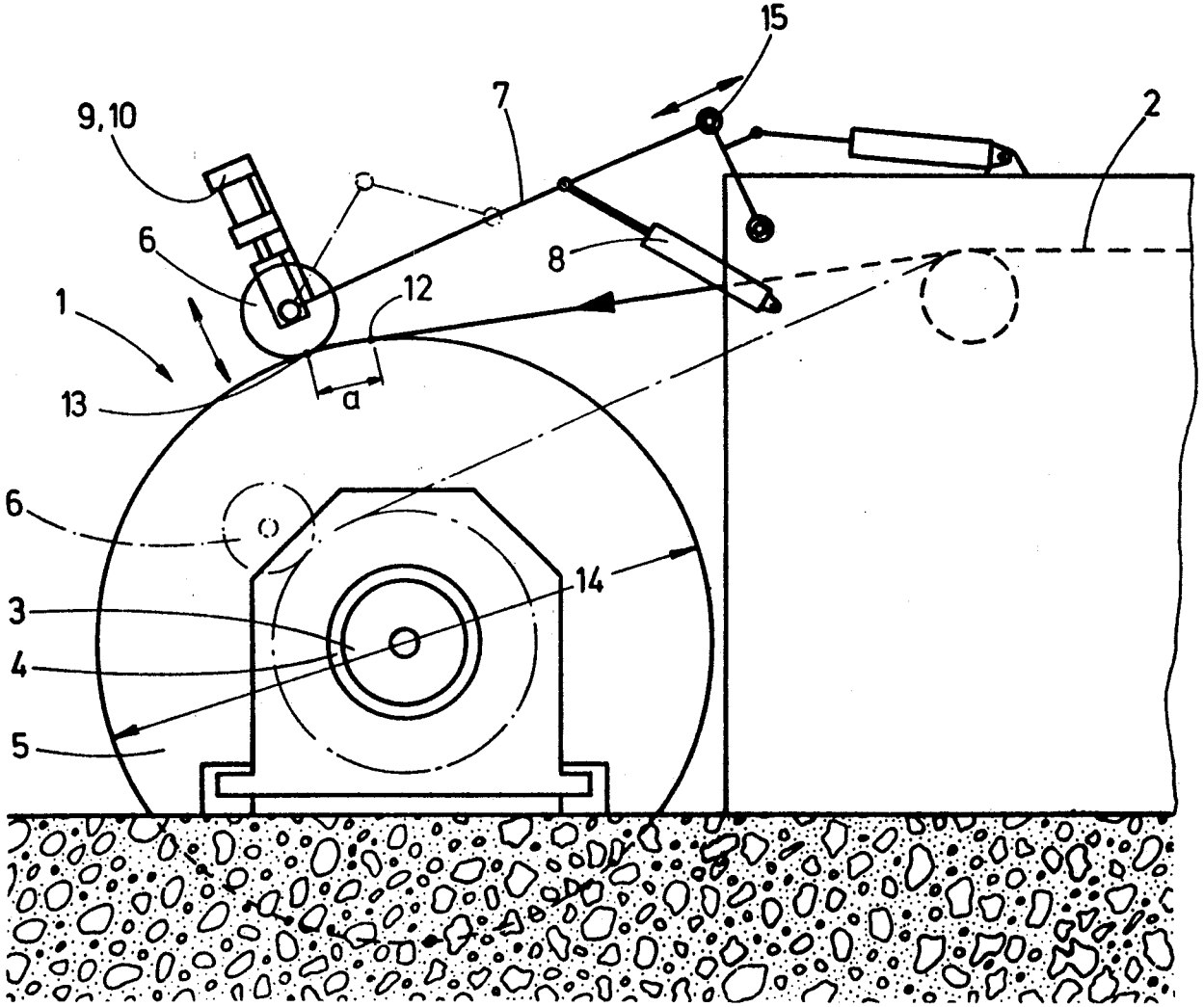
FIG. 1 is a lateral view of the strip coiler.
Figure 2A:
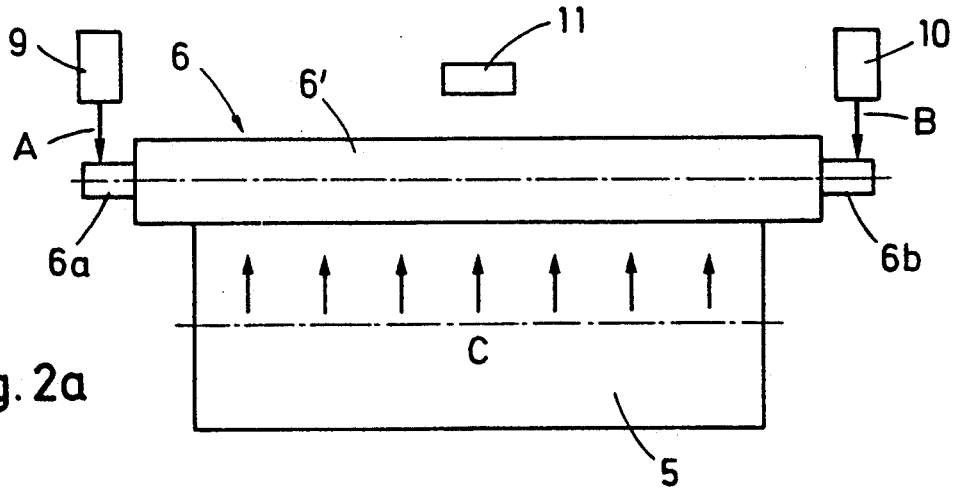
FIGS. 2a–2c show the mode of operation of the control for the horizontal desired position of the smoothing roll.

The strip coiler 1 according to FIGS. 1 and 2 for the winding up and unwinding of a thin-gage or foil strip 2 of metal comprises a coiler mandrel 3 for receiving the coiler reel 4 of a coil 5; the coiler mandrel is rotatably supported in a machine stand and consists of two clamping cones. The strip coiler 1 is equipped with a smoothing roll 6 mounted on pivoting lever 7; by means of a pressure cylinder 8 engaging the pivot lever 7, the smoothing roll can be lowered onto the coil 5 and lifted off the latter.

The smoothing roll 6 attached to the pivoting lever 7 or optionally two pivoting levers is urged against the coil 5 during the winding up or unwinding of a thin-gage or foil strip 2 onto or from the coiler reel 4 of the coiler mandrel 3 by means of two operating cylinders 9, 10 engaging the two ends 6a, 6b of the smoothing roll; the control forces A, B of these cylinders can be regulated.

The strip coiler 1 is equipped with a control capability for the horizontal desired position 6' of the smoothing roll 6, oriented in parallel to the coiler mandrel 3, this control being carried out by adjustment of the control forces A, B of the operating cylinders 9, 10 of the smoothing roll 6 in dependence on the inclined position 6'', 6''' of the smoothing roll 6 caused by defects in the strip 2 or by unavoidable out-of-roundness of the surface of the strip 2 wound onto the coiler reel 4. Deviations of the smoothing roll 6 from the horizontal desired position 6' are detected by a sensor 11.

The control for adjusting the horizontal desired position 6' of the smoothing roll 6 during the winding up and unwinding of a foil strip 2 onto or from the coiler reel 4 of the strip coiler 1 operates as follows:

At the beginning of the coiling step, the control forces A and B of the two operating cylinders 9, 10 of the smoothing roll 6 are set at the same desired value S so that the predetermined contact force C is obtained between the smoothing roll 6 and the coil 2. According to FIG. 2a, the following relationships apply:

$$A=B=S$$

$$\overline{C}=\overline{A}+\overline{B}$$

Figure 2B:
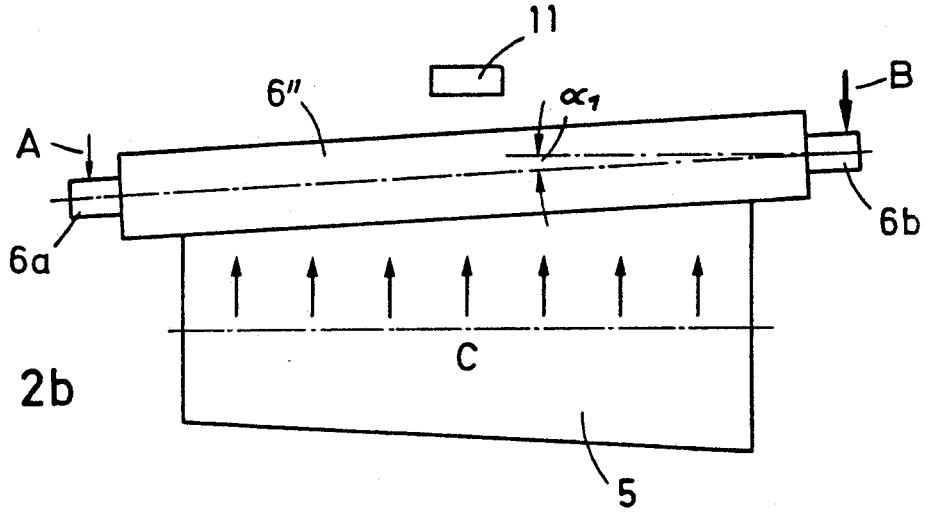

If the foil strip 2, in accordance with the illustration in FIG. 2*b*, runs onto the coil 5 in a central oblique position on account of a strip defect, then the smoothing roll 6, pressed against the coil 5 by the control forces A, B of the operating cylinders 9, 10, assumes the central oblique position 6″ with respect to the horizontal position 6′; this position 6″ is determined by the angle of inclination $\alpha_1$ and is detected by the sensor 11. At this point, the positional control for the smoothing roll 6 becomes active in such a way that, for example, the control force A is reduced to half the desired value S, and the control force B is increased by half the desired value S, and thereby the end 6*b* of the smoothing roll 6 is urged to a greater extent against the coil 5 than the end 6*a* of the roll. According to FIG. 2*b*, the following relationships apply:

$$A=0.5\,S$$

$$B=1.5\,S$$

$$\overline{C}=\overline{A}+\overline{B}$$

The control remains operative until the foil strip 2 runs up against the coil 5 again horizontally, and the smoothing roll 6 has assumed the horizontal desired position 6′.

Figure 2C:
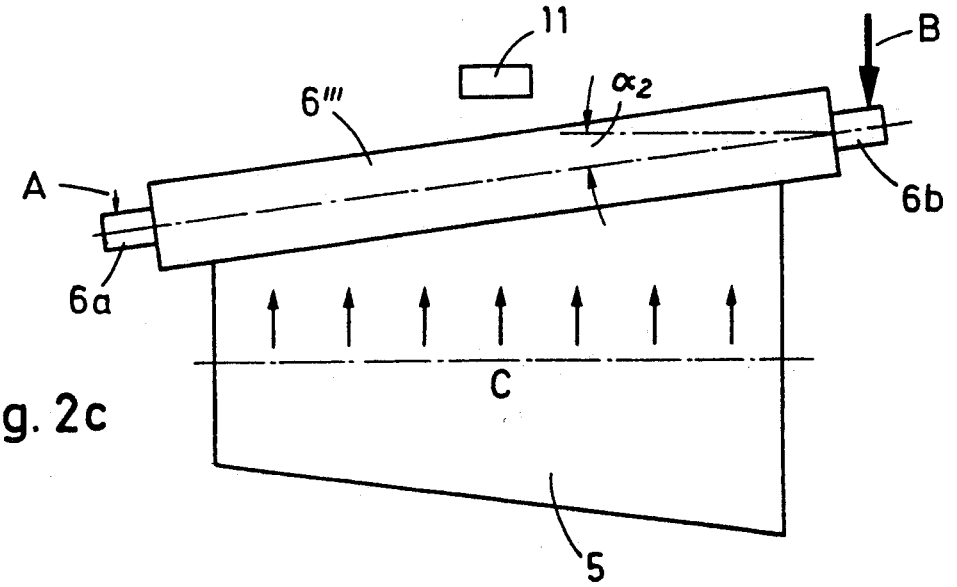
Figure 3:
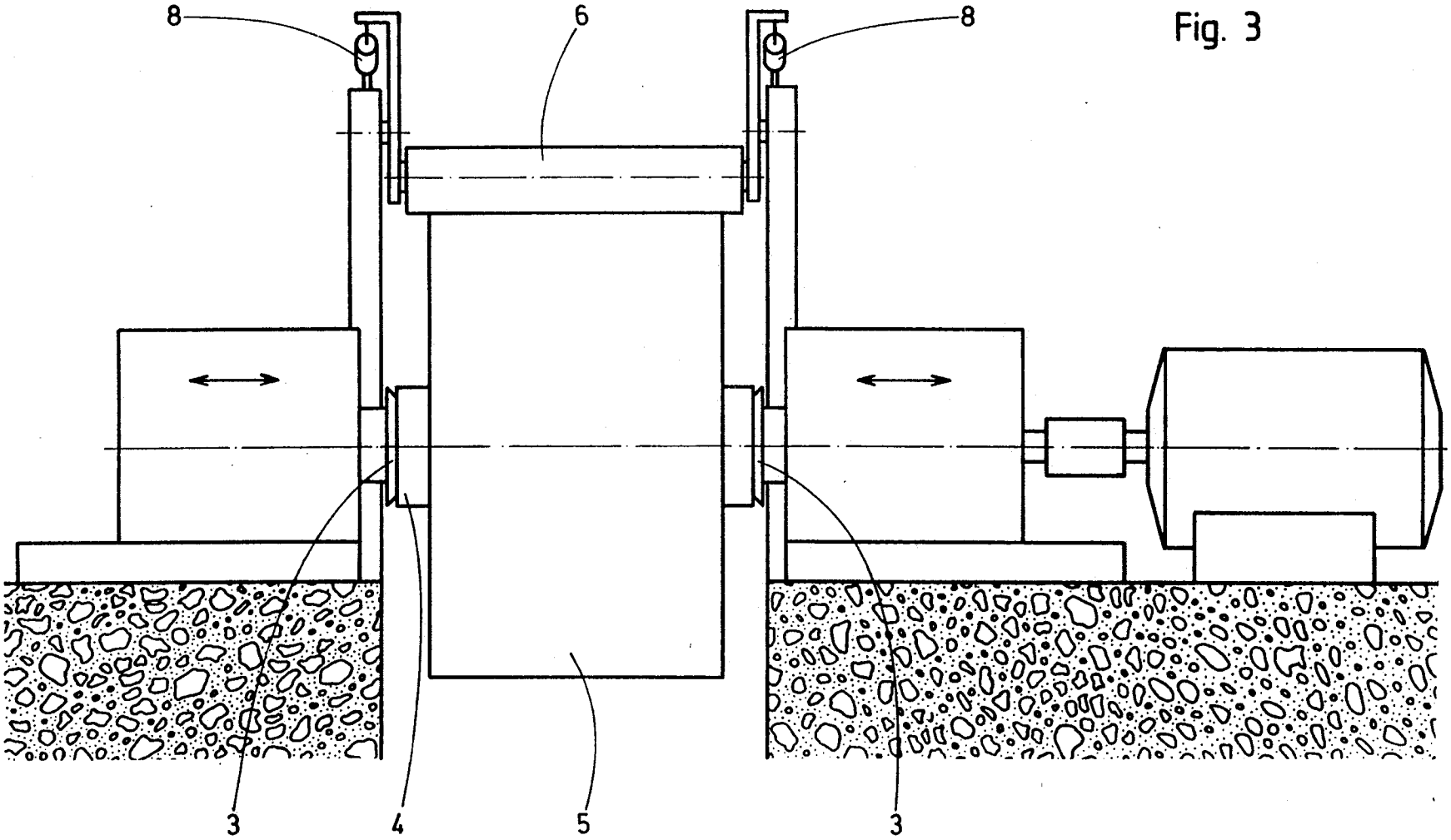
FIG. 3 is an elevational view of the device from the left of FIG. 1.

In case the smoothing roll 6 assumes the extreme inclined position 6‴ according to FIG. 2*c*, covered by the angle of inclination $\alpha_2$, on account of imperfect winding of the foil strip 2 entering the coil 5, then, by means of the positional control of the smoothing roll 6, for example the control force A of the operating cylinder 9 is set to a value of 0, and the control force B of the operating cylinder 10 is set at twice the desired value S until the foil strip 2 runs up on the coil 5 again horizontally, and the smoothing roll 6 assumes the horizontal desired position 6′. With this control, the following relationships apply:

$$A=0$$

$$B=2\,S$$

$$\overline{C}=\overline{A}+\overline{B}$$

In order to avoid damage to the coil 5 and the smoothing roll 6 due to a vibrating movement of the roll, triggered by flawed windup or unwinding of the thin-gage or foil strip 2, there is the possibility of cutting out the positional regulation of the smoothing roll 6 or of setting the control forces A, B of the operating cylinders 9, 10 of the smoothing roll 6 to a minimum value as soon as the oscillations of the smoothing roll 6 surpass a critical value.

The strip coiler 1 is furthermore equipped with control capability for adjusting the distance a between the entrance point 12 of the strip 2 at the coil 5 and the contact point 13 of the smoothing roll 6 and the coil 5, in dependence on the coil diameter 14.

The distance control operates preferably as a constant control which regulates the distance a at varying diameters 14 of the coil 5 to a constant value.

The distance regulation between the entrance point 12 of the strip 2 at the coil 5 and the contact point 13 of the smoothing roll 6 and the coil 2 can be conducted by a longitudinal adjustment of the pivoting lever or levers 7 carrying the smoothing roll 6, or by an adjustment of the pivoting point 15 of the pivoting lever or pivoting levers 7.

We claim:

1. In a strip coiler for the winding up and unwinding of thin strip material of metal, with a rotatably supported horizontal coiler mandrel for receiving a coil of said strip, and at least one smoothing roll adjustable with respect to the coiler mandrel for pressing the strip against the coil, and with a control of the horizontal desired position of the smoothing roll; the improvement comprising means for regulating the position (6′) of the smoothing roll (6) in dependence on an inclined position (6″, 6‴) of the smoothing roll (6) relative to the coiler mandrel caused by irregularities in the strip (2), the line connecting the coil axis and the point of tangency where the strip first contacts the coil and the line between the point of application of said smoothing roll against the coil and the coil axis being spaced apart by a predetermined distance (a) at the points where said intersect the coil surface, said lines forming with the axis of the coiler mandrel an acute dihedral opening away from said axis, there being straight elongated levers (7) carrying the smoothing roll (6), and means for moving said levers (7) in a direction parallel to their length thereby to maintain said distance (a) constant despite changes in the diameter of the coil (5).

* * * * *